US007863876B2

(12) United States Patent
Cook et al.

(10) Patent No.: US 7,863,876 B2
(45) Date of Patent: Jan. 4, 2011

(54) BUILT-IN SELF-CALIBRATION (BISC) TECHNIQUE FOR REGULATION CIRCUITS USED IN NON-VOLATILE MEMORY

(75) Inventors: Thomas D. Cook, Austin, TX (US); Tahmina Akhter, Austin, TX (US); Jeffrey C. Cunningham, Austin, TX (US)

(73) Assignee: Freescale Semiconductor, Inc., Austin, TX (US)

( * ) Notice: Subject to any disclaimer, the term of this patent is extended or adjusted under 35 U.S.C. 154(b) by 413 days.

(21) Appl. No.: 12/055,538

(22) Filed: Mar. 26, 2008

(65) Prior Publication Data

US 2009/0243571 A1 Oct. 1, 2009

(51) Int. Cl.
*G05F 1/575* (2006.01)

(52) U.S. Cl. ..... 323/280; 323/281; 323/349

(58) Field of Classification Search ..... 323/273, 323/275, 280, 281, 349
See application file for complete search history.

(56) References Cited

U.S. PATENT DOCUMENTS 6,738,298 B1 5/2004 Cioaca et al.
7,200,066 B2 4/2007 Krenzke et al.
2005/0077883 A1 * 4/2005 Walters ..... 323/273
2009/0243571 A1 * 10/2009 Cook et al. ..... 323/280

* cited by examiner

*Primary Examiner*—Jeffrey L Sterrett
(74) *Attorney, Agent, or Firm*—Hamilton & Terrile, LLP; Michael Rocco Cannatti

(57) ABSTRACT

A reference voltage regulation circuit (143) is provided in which one or more input voltage signals (Vref, Vref') are selectively coupled to a configurable amplifier (114) which is coupled through a sample and hold circuit (120) to a voltage follower circuit (122) which is coupled in feedback to the configurable amplifier (114) for generating an adjusted output voltage at a circuit output (130), where the voltage follow circuit comprises a resistor divider circuit (126) that is controlled by a calibration signal (Cal<n:0>) generated by a counter circuit (128) selectively coupled to the output of the configurable amplifier when configured as a comparator for generating the calibration signal in response to a clock signal, where the calibration signal represents a voltage error component (Verror, Voffset) that is removed from the circuit output when the calibration signal is applied to the resistor divider circuit during normal operational.

20 Claims, 10 Drawing Sheets

- PRIOR ART -

BUILT-IN SELF-CALIBRATION (BISC) TECHNIQUE FOR REGULATION CIRCUITS USED IN NON-VOLATILE MEMORY

BACKGROUND OF THE INVENTION

1. Field of the Invention

The present invention is directed in general to voltage regulation in an integrated circuit. In one aspect, the present invention relates to an on-chip method and system for regulating and calibrating the supply or reference voltage of an integrated circuit memory device.

2. Description of the Related Art

Many integrated circuit devices, such as a non-volatile memory device, use an on-chip reference voltage generator to generate an internal reference voltage from an external reference voltage. In one example, the internal reference voltage is generated by shifting the output of a bandgap voltage generator or some other temperature insensitive voltage generator. Referring to FIG. 1, a commonly-used reference voltage generator circuit 1 is constructed with an operational amplifier 2 and a voltage follower circuit 3 which consists of a transistor 17 and resistor 19 placed in the feedback path of the operational amplifier 2. The reference voltage generator circuit 1 receives an external reference voltage Vref at the negative input node 10 of the op amp 2, and generates an output voltage Vout at the source follower 18. However, there can be a number of errors introduced that can impair the resulting accuracy of the output voltage Vout. Such errors can arise when a bandgap voltage is used for the input reference voltage Vref if the bandgap voltage is not well suited for the regulation circuit. Errors can also be caused by variations in resistor matching, and from other differences that can arise when the same circuit is formed on separate die. In the voltage generator circuit 1 shown in FIG. 1, these error sources are represented by the Verror term at the negative input node 10, where the term Vref' represents the desired reference voltage to be generated by the voltage generator circuit 1. Another source of error in the generated output voltage Vout is caused by the opamp offset voltage Voffset that represents the difference in op amp performance as compared to an "ideal" op amp 14. In the voltage generator circuit 1 shown in FIG. 1, this error source is represented by the Voffset source 11 that is connected in series with the positive input terminal of the "ideal" op amp 14, though it can be placed in series with either terminal and its value will be a random variable. The offset error Voffset appears at the output Vout and sums with the reference voltage Vref, Vout=Vref+Voffset.

As circuits are increasingly designed with smaller and smaller voltages (e.g., low power applications), it is becoming increasingly important to generate internal reference voltages that are accurate to within a percent, particularly as the smaller voltages are used which reduce the room for error when generating the internal reference voltage(s). While different solutions have been proposed for addressing the different types of error source, none have proven entirely satisfactory. For example, errors contained in the input voltage Verror can be addressed by adjusting or trimming the resistor divider 19 during test by digitally selecting one of the switched taps in the resistor divider 19. The tap selection can be determined individually for each device by monitoring the Vout signal and searching for an optimal tap, but this approach requires costly test time. The tap selection may also be generalized for all devices by characterizing all devices, but selecting a tap based on characterization places a burden on processing, and requires resources to monitor the validity of the choice throughout the life of the product. Thus, neither method is optimal in the production environment. While automated reference voltage regulation circuits have been proposed, such as described in U.S. Pat. No. 6,738,298 to Cioaca et al, they do not address all of the error sources (such as the opamp offset voltage error source) and also suffer from undue circuit complexity. Indeed, common offset suppression techniques increase circuit size and complexity, and are one major reason that analog circuitry does not scale with decreasing feature size.

Accordingly, there is a need for an improved system and methodology for efficiently regulating a reference voltage generator circuit to remove error sources from the input voltage source and from the opamp offset voltage. There is also a need for an automatic reference voltage regulation circuit which overcomes the problems in the art, such as outlined above. Further limitations and disadvantages of conventional solutions and technologies will become apparent to one of skill in the art after reviewing the remainder of the present application with reference to the drawings and detailed description which follow.

BRIEF DESCRIPTION OF THE DRAWINGS

The present invention may be understood, and its numerous objects, features and advantages obtained, when the following detailed description of a preferred embodiment is considered in conjunction with the following drawings, in which.

DETAILED DESCRIPTION

Figure 1:
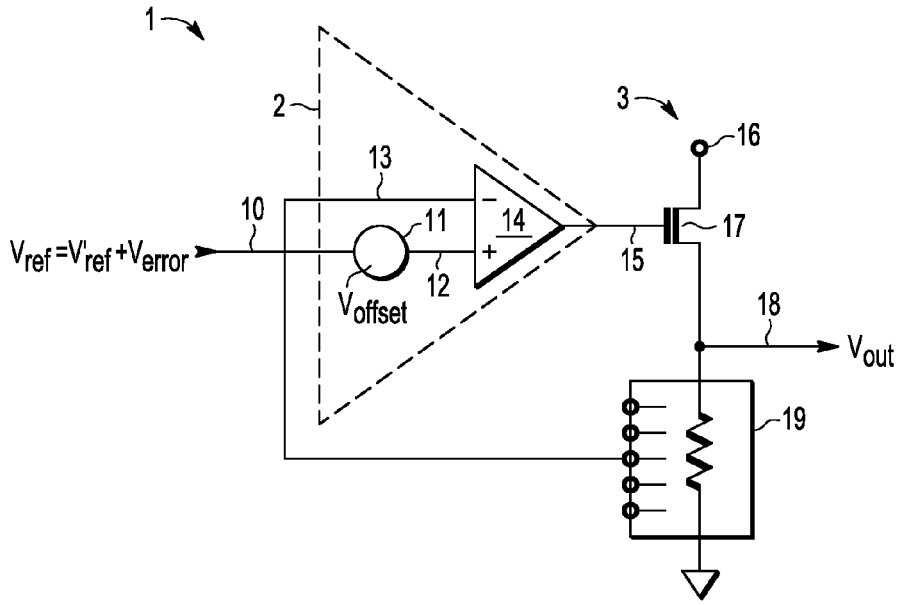
FIG. 1 is a simplified circuit schematic of a conventional reference voltage generator circuit formed with an operational amplifier and a voltage follower circuit.

A voltage regulation circuit system and methodology are described for generating a reference voltage with a regulation circuit having built-in calibration and offset cancellation. The voltage regulation circuit includes an operational amplifier (which may be configured to operate as either an amplifier or comparator) and a voltage follower circuit that is coupled in the feedback path of the configurable operational amplifier. In addition, a sample and hold circuit is coupled between the configurable operational amplifier and the voltage follower circuit. The voltage follower circuit includes a multi-tap resistor divider circuit which is controlled by the output from an up/down counter that is selectively coupled to and controlled by the output from the configurable op amp. With this configuration, an input voltage (e.g., an externally provided reference voltage) can be calibrated to remove an error voltage component (e.g., the difference between the received reference voltage and the desired reference voltage) by applying the input voltage at a first input node of the configurable op amp and sampling the op amp output with the sample and hold circuit. Next, the error voltage is measured by placing the sample and hold circuit into a "hold" mode, configuring the op amp as a comparator, connecting the comparator output to the up/down counter and applying the desired reference voltage to the first input node (which may be provided from an external test device). After a sufficient number of clock cycles, the up/down counter output provides a digital representation of the error voltage component. By inverting the resulting counter output before applying it to the multi-tap resistor, a negative of the error voltage (at least to within a least significant bit error term) is introduced into the feedback path when the voltage regulation circuit is returned to an operational mode. A similar processing sequence may be used to provide offset cancellation, although the offset measurement step requires that the op amp inputs be swapped. In particular, an input voltage (including the offset voltage term) is applied at a first input node of the configurable op amp and sampled with the sample and hold circuit. Next, the sample and hold circuit is placed into a "hold" mode and the op amp inputs are swapped so that the input voltage is connected to the second input node of the configurable op amp while the first input node is connected to the multi-tap resistor. Once the op amp inputs are swapped, the offset voltage is measured by configuring the op amp as a comparator and connecting the comparator output to the up/down counter. After a sufficient number of clock cycles, the up/down counter output provides a digital representation of a value equal to twice the offset voltage component. By inverting the resulting counter output and dividing the result by two (e.g., with a shift of bits toward the least significant bit) before applying it to the multi-tap resistor, the offset voltage is cancelled from the output of the voltage regulation circuit when the voltage regulation circuit is returned to an operational mode. The processing sequences for calibration and offset cancellation can both be performed with a reference voltage generator circuit by converting the op amp into a comparator and using a few additional switches to connect the inputs and a counter to the op amp/comparator output for sampling, cancelling, re-sampling, measuring, inverting and feeding back the error component.

Various illustrative embodiments of the present invention will now be described in detail with reference to the accompanying figures. While various details are set forth in the following description, it will be appreciated that the present invention may be practiced without these specific details, and that numerous implementation-specific decisions may be made to the invention described herein to achieve the circuit designer's specific goals, such as compliance with process technology or design-related constraints, which will vary from one implementation to another. While such a development effort might be complex and time-consuming, it would nevertheless be a routine undertaking for those of ordinary skill in the art having the benefit of this disclosure. For example, selected aspects are shown in simplified schematic diagram form, rather than in detail, in order to avoid limiting or obscuring the present invention. In addition, some portions of the detailed descriptions provided herein are presented in terms of algorithms or operations on data within a computer memory. Such descriptions and representations are used by those skilled in the art to describe and convey the substance of their work to others skilled in the art. Various illustrative embodiments of the present invention will now be described in detail below with reference to the figures.

Figure 2:
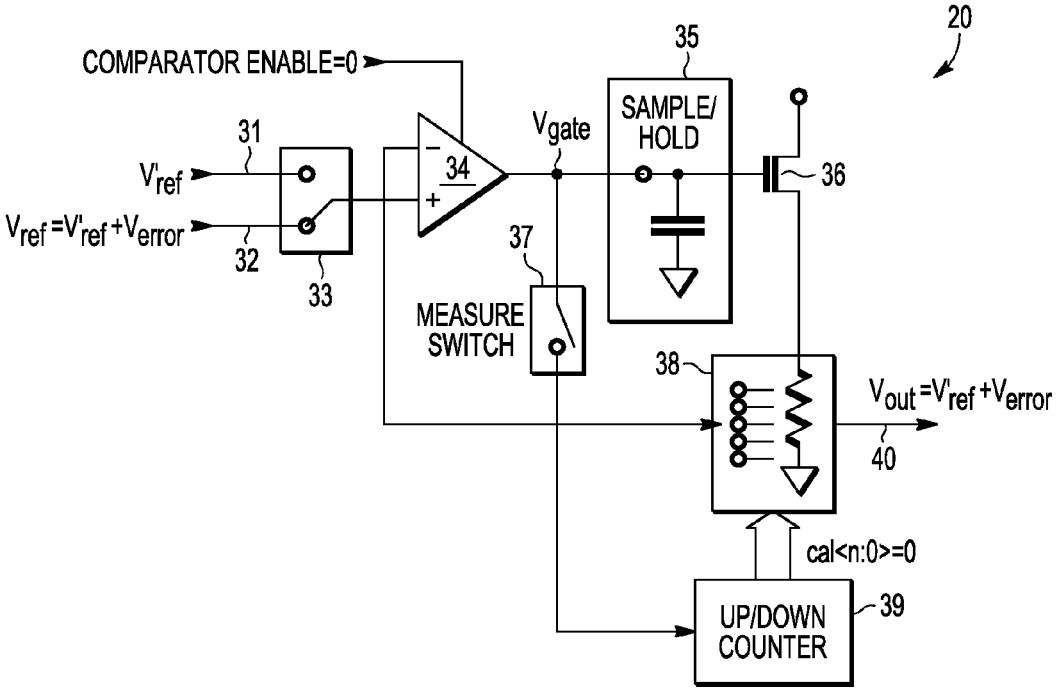
FIG. 2 is a schematic diagram of a built-in self calibrating reference voltage generator circuit in a sample mode in accordance with selected embodiments of the present invention.

To illustrate how reference voltage errors can be removed by the self-calibrating voltage regulation circuit, reference is now made to FIG. 2 which depicts in schematic diagram form a built-in self calibrating reference voltage generator circuit 20 which is used to sample and measure an error voltage component contained in an external reference voltage so that a voltage source equal to the negative of the error voltage component can be inserted into the feedback of the amplifier, thereby removing the error voltage component from the output. As illustrated, the voltage generator circuit 20 includes an input switch 33 for selectively coupling an input voltage to a configurable operational amplifier 34 which may be configured to operate as either an amplifier or comparator. The output from the configurable operational amplifier 34 is coupled to a sample and hold circuit 35, which in turn is coupled to a voltage follower circuit 36 that is coupled in the feedback path of the configurable operational amplifier 34. In selected embodiments, the sample and hold circuit 35 can be realized using a switch and the gate capacitance of the voltage follower circuit 36. As for the voltage follower device 36, a multi-tap resistor divider circuit 38 is provided so that the resistance in the feedback path may be digitally selected. The selection of the resistance value at the divider circuit 38 is controlled by an up/down counter 39 that generates a digital calibration signal Cal<n:0> and that is selectively connected to the output from the configurable op amp 34 by a measure switch 37.

In the sampling mode, the positive input of the op amp 34 is connected to receive an external reference voltage Vref 32 that is provided to the circuit 20 through an external Vref pad or other such connection. The external reference voltage Vref represents the desired reference voltage Vref (prime) and an error voltage component Verror. During sampling, the configurable op amp 34 is configured as an op amp (e.g., by enabling the opamp frequency compensation network) and the sample and hold circuit 35 is placed in sample mode. In addition, the measure switch 37 is open, but the digital calibration signal Cal<n:0> is set to the same tap as the Vout tap (e.g., with all bits=0). With this configuration, the op amp output generates an output Vgate that is sampled by the sample and hold circuit 35, allowing the voltage follower circuit 36, 38 to develop an output voltage Vout representing the sum of the desired reference voltage Vref (prime) and the error voltage component Verror. Thus, the "Vgate" voltage is the opamp output required to generate the "Vout" that is equal to the sum of the reference voltage and the error voltage.

Figure 3:
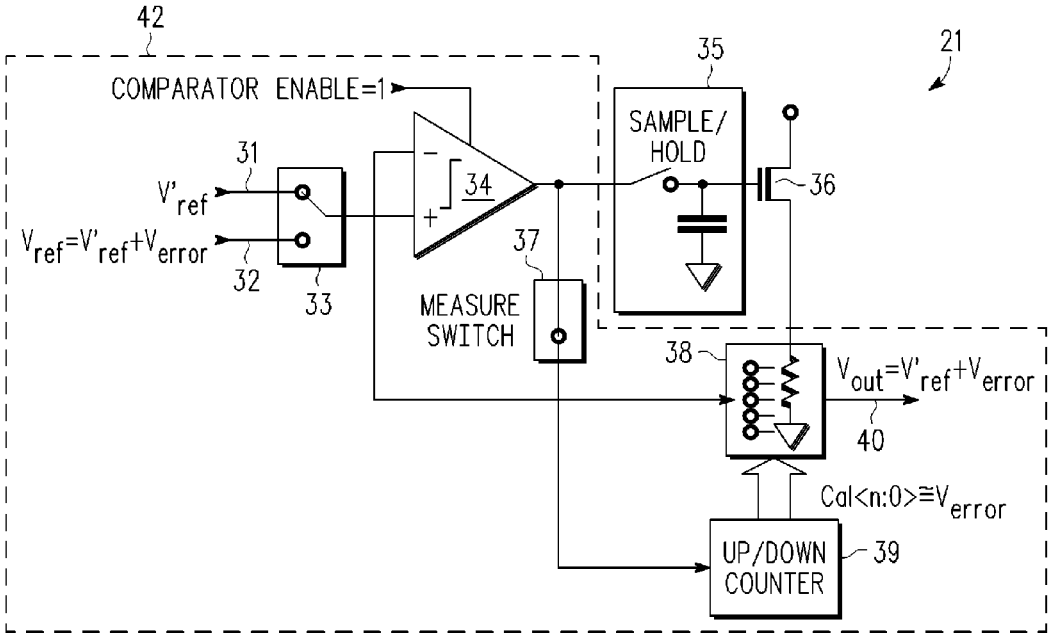
FIG. 3 is a schematic diagram of a built-in self calibrating reference voltage generator circuit in a measurement mode in accordance with selected embodiments of the present invention.

To measure the error voltage Verror, the reference voltage generator circuit 21 is effectively configured to operate as an analog to digital converter during a measurement mode, as shown in FIG. 3. In particular, the positive input of the op amp 34 is connected to receive the desired reference voltage Vref (prime) 31 that is provided to the circuit 21 by an external test circuit. In addition, the configurable op amp 34 is configured as a comparator (e.g., by disabling the opamp frequency compensation network), the sample and hold circuit 35 is placed in hold mode, and the measure switch 37 is closed. With this configuration, the divider circuit 38, comparator 34 and up/down counter 39 operate as an analog-to-digital (A/D) converter which measures the error voltage Verror by driving digital calibration signal Cal<n:0> with the up/down counter 39 in response to the comparator output while the sampled external reference voltage Vref is applied to the top of the resistor string in the divider circuit 38. In particular, as the up-down counter 39 is successively clocked, the digital calibration signal output Cal<n:0> is incremented if the comparator output is high, and is decremented if it is low. After a sufficient number of clocks, the digital calibration signal Cal<n:0> will represent the voltage at the positive input of the comparator 34, namely the desired reference voltage Vref (prime). However, the digital calibration signal Cal<n:0> also represents the error voltage Verror which is the difference between the externally provided reference voltage Vref and the desired reference voltage Vref (prime). This follows from the understanding that the equation for the A/D converter is Vref (prime)=(Cal<n:0>/$2^{(n+1)}$)×Vref. Since the value of the least significant bit LSB=Vref/$2^{(n+1)}$, the value of Cal<n:0> is the number of LSBs between Vref and Vref (prime) which represents the error voltage Verror.

Figure 4:
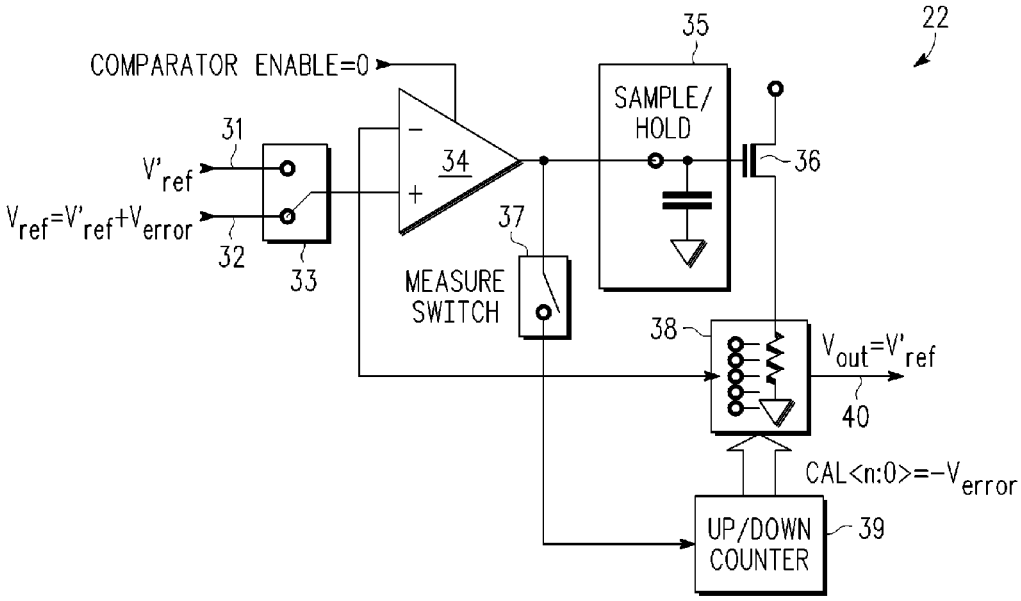
FIG. 4 is a schematic diagram of a built-in self calibrating reference voltage generator circuit in an operational mode in accordance with selected embodiments of the present invention.

After conversion of the error voltage, the reference voltage generator circuit 22 returns to an operational mode as shown in FIG. 4. In particular, the input switch 33 connects the positive input of the opamp 34 to the external reference voltage 32 (Vref=Vref (prime)+Verror), the configurable op amp 34 is configured as an operational amplifier (Comparator Enable=0), the measure switch 37 is opened to prevent further changes at the counter 39, and the sample and hold circuit 35 is placed in sample mode. With this configuration, the counter 39 is no longer being driven by the output of the opamp/comparator 34, but the digital calibration signal Cal<n:0> output from the counter 39 still represents the previously measured error voltage Verror. By changing the sign of the counter output (e.g., performing a one's complement on the digital calibration signal Cal<n:0>) before applying the inverted counter output value to the resistor tap 38, a negative of the error voltage (−Verror) may be applied to the feedback of the voltage generator circuit 22, thereby removing the error voltage from the circuit output 40 Vout=Vref (prime). As will be appreciated from the foregoing, the disclosed calibration technique leaves a single LSB error in the correction voltage (1's complement instead of 2's complement) that should be considered when choosing the LSB of the A/D converter or the size of the counter 39.

Figure 5:
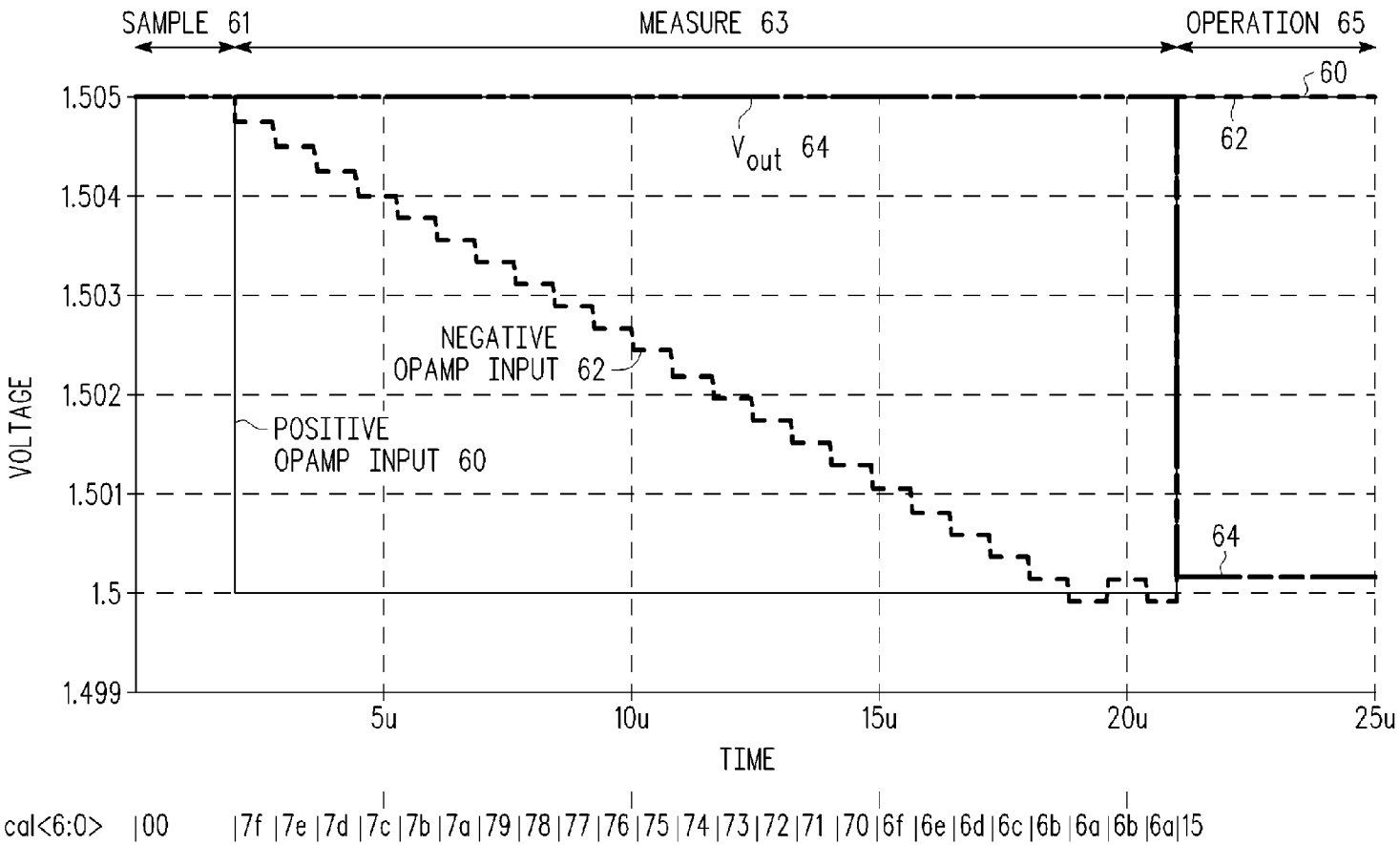
FIG. 5 depicts a simulation plot for the built-in self calibrating reference voltage generator circuit in the sample, measurement and operational modes in accordance with selected embodiments of the present invention.

As seen from the foregoing, the reference voltage generator circuit 20-22 calibrates itself in three steps—sampling, measuring and operating. Each of these steps is depicted in FIG. 5's simulation plot for the built-in self calibrating reference voltage generator circuit 20-22. Plot line 60 simulates the voltage at the positive input to the op amp 34, plot line 62 simulates the voltage at the negative input to the op amp 34, and plot line 64 simulates the circuit output Vout generated by the reference voltage generator circuit output 40. For this simulation, the desired voltage Vref (prime) is 1.5V, the error voltage Verror is 5 mV, and a 7-bit counter is used. During the sample phase 61, the circuit output 64 is 1.505V, which is the sum of the desired voltage Vref (prime) and the error voltage Verror. During the measurement phase 63, the circuit output 64 is held at 1.505V by virtue of the sample and hold circuit being placed in a hold mode. However, during the measurement phase, the counter moves up or down, depending on whether the output voltage is below or above the desired voltage. Thus, in the simulated plot, the counter decrements for so long as the output of the opamp 34 is greater than the desired voltage (1.5V). The decrementing sequence of counter values Cal<6:0> for the 7-bit counter is shown at the bottom of FIG. 5, starting at the initial "00" value. The decrementing counter output, in turn, steps down the voltage 62 at the negative input to the op amp 34. Once the output reaches the desired voltage (at approximately 19 us), the counter dithers between the "6a" and "6b" values. The duration of the measurement phase 63 is determined by the size of the counter so as to allow a sufficient number of clocks that the entire counter range can be clocked if necessary. For example, with a 7-bit counter, the measurement phase 63 should allow at least 64 clock cycles where the starting point of the counter will select the middle tap of the resistor string, though the depicted measurement phase 63 is truncated in the simulation.

After a sufficient number of clocks, the circuit enters a normal operation phase 65 where the counter is stopped and the positive input to the op amp is connected to the external voltage reference signal (Vref(prime)+Verror), as shown by the increase in the plot line 60 at the operation phase 65. In the normal operation phase, the inverse of the counter output is applied to the resistor taps, the op amp is re-configured as such (e.g., by re-connecting the compensation network) and the sample and hold circuit is placed into a sample mode. As a result, the circuit output Vout 64 shifts to within 1 LSB of the desired reference voltage (Vref (prime)), as seen by the drop in the plot line 64 in the operation phase 65. By storing the inverse of the counter as correction data in non-volatile memory, the regulator circuit can be calibrated for the life of the device.

Figure 6:
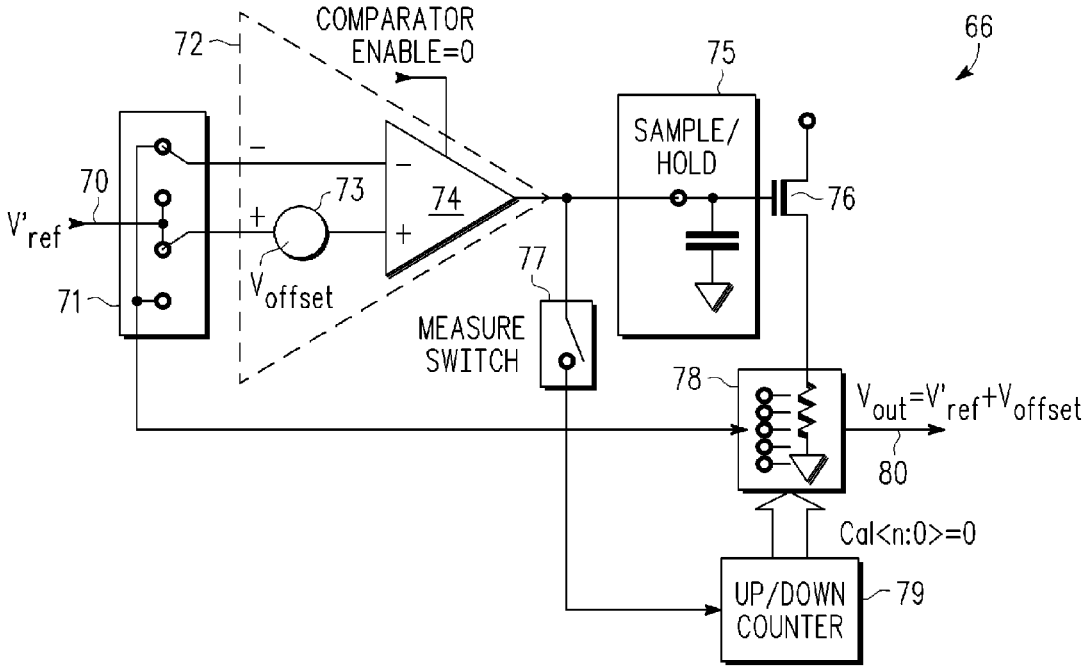
FIG. 6 is a schematic diagram of a built-in self calibrating reference voltage generator circuit that is configured to remove an offset voltage by sampling the sum of the offset voltage and an input reference voltage in accordance with selected embodiments of the present invention.

While error components included in the external voltage reference can be removed using the self-calibration circuit described with reference to FIGS. 2-5, self-calibration techniques cannot compensate for the opamp offset voltage. However, by reconfiguring the self-calibrating reference voltage generator circuit, the offset voltage can be removed or cancelled from the circuit output. To illustrate how offset voltage errors can be removed, reference is now made to FIG. 6 which depicts in schematic diagram form a built-in self calibrating reference voltage generator circuit 66 which is used to sample and measure an offset voltage contained in the circuit's amplifier 72 so that a voltage source equal to the negative of the offset voltage component can be inserted into the feedback of the amplifier, thereby removing the offset voltage component from the output. As illustrated, the voltage generator circuit 66 includes an input switch 71 for selectively coupling an input reference voltage Vref to either of the inputs of the configurable amplifier 72 which may be configured to operate as either an amplifier or comparator. The input switch 71 is also connected and controlled to selectively couple the multi-tap resistor divider circuit 78 to either of the inputs of the configurable amplifier 72. In selected embodiments, the input switch 71 is implemented with a double pole, double throw (DPDT) switch. In this example, the offset voltage is depicted as a voltage source 73 in series with the positive input terminal of an ideal opamp 74 that together form the configurable amplifier 72. The output from the configurable amplifier 72 is coupled to a sample and hold circuit 75, which in turn is coupled to a voltage follower circuit 76 that is coupled in the feedback path of the configurable amplifier 72. In the voltage follower circuit 76, a multi-tap resistor divider circuit 78 is provided so that the resistance in the feedback path may be digitally selected. To control the divider circuit 78, an up/down counter 79 generates a digital calibration signal Cal<n:0> in response to the comparator-configured output from the configurable amplifier 72.

In an initial sampling phase, the desired reference voltage Vref (prime) 70 from an external test circuit is connected to the offset voltage source 73 at the positive input of the amplifier 72 via input switch 71. During sampling, the configurable op amp 72 is configured as an op amp (e.g., by enabling the opamp frequency compensation network) and the sample and hold circuit 75 is placed in sample mode. In addition, the measure switch 77 is open, but the digital calibration signal Cal<n:0> is set to the same tap as the Vout tap (e.g., with all bits=0). With this configuration, the op amp output generates an output Vgate that is sampled by the sample and hold circuit 75, allowing the voltage follower circuit 76, 78 to develop an output voltage Vout representing the sum of the desired reference voltage Vref (prime) and the offset voltage component Voffset.

Figure 7:
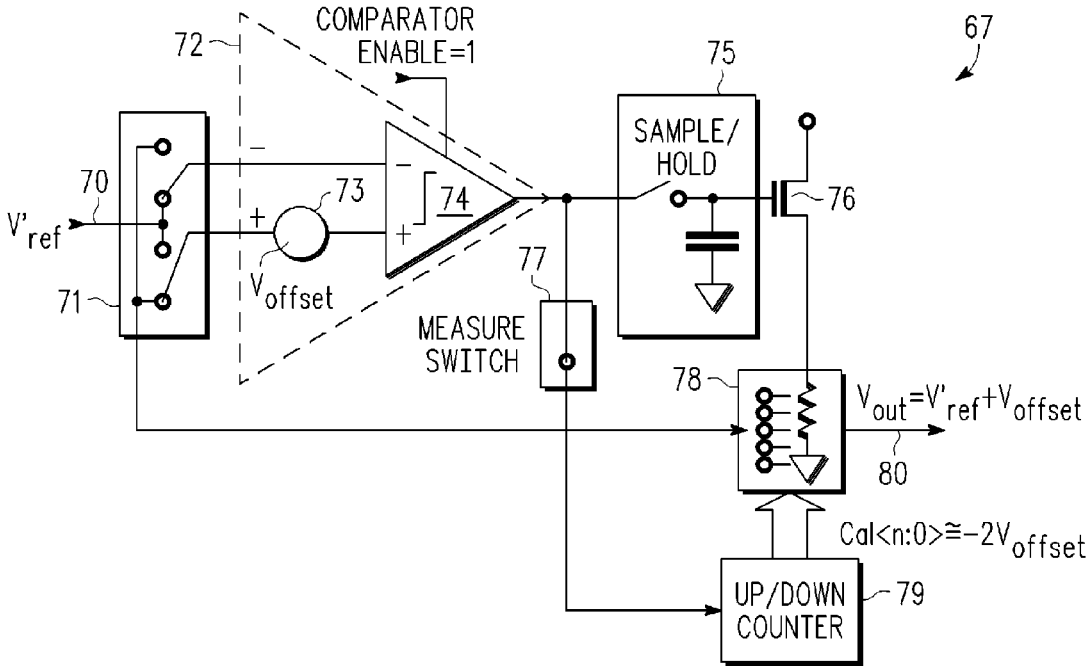
FIG. 7 is a schematic diagram of a built-in self calibrating reference voltage generator circuit that is configured to remove an offset voltage by measuring the offset voltage with an analog-to-digital converter in accordance with selected embodiments of the present invention.

To measure the offset voltage Voffset, the reference voltage generator circuit 67 is effectively configured to operate as an A/D converter during a measurement mode, but with the opamp inputs swapped by the input switch 71, as shown in FIG. 7. In particular, the input switch 71 connects the negative input of the amplifier 72 to receive the desired reference voltage Vref (prime) 70 that is provided to the circuit 67 by an external test circuit. Simultaneously, the input switch 71 connects the offset voltage 73 at the positive input of the amplifier 72 to the divider circuit 78. In the measurement phase, the configurable amplifier 72 is also configured as a comparator (e.g., by disabling the opamp frequency compensation network), the sample and hold circuit 75 is placed in hold mode, and the measure switch 77 is closed. With this configuration, the divider circuit 78, comparator 72 and up/down counter 79 operate as an A/D converter to measure the offset voltage Voffset by driving digital calibration signal Cal<n:0> with the up/down counter 79 in response to the comparator output while the sampled voltage (Vref (prime)+Voffset) is applied to the top of the resistor string in the divider circuit 78. After a sufficient number of clocks, the digital calibration signal Cal<n:0> will represent a value that is equal to twice the offset voltage error (2×Voffset) between the circuit output 80 and the positive input of the ideal comparator 74, based on the equation for the A/D converter described above.

Figure 8:
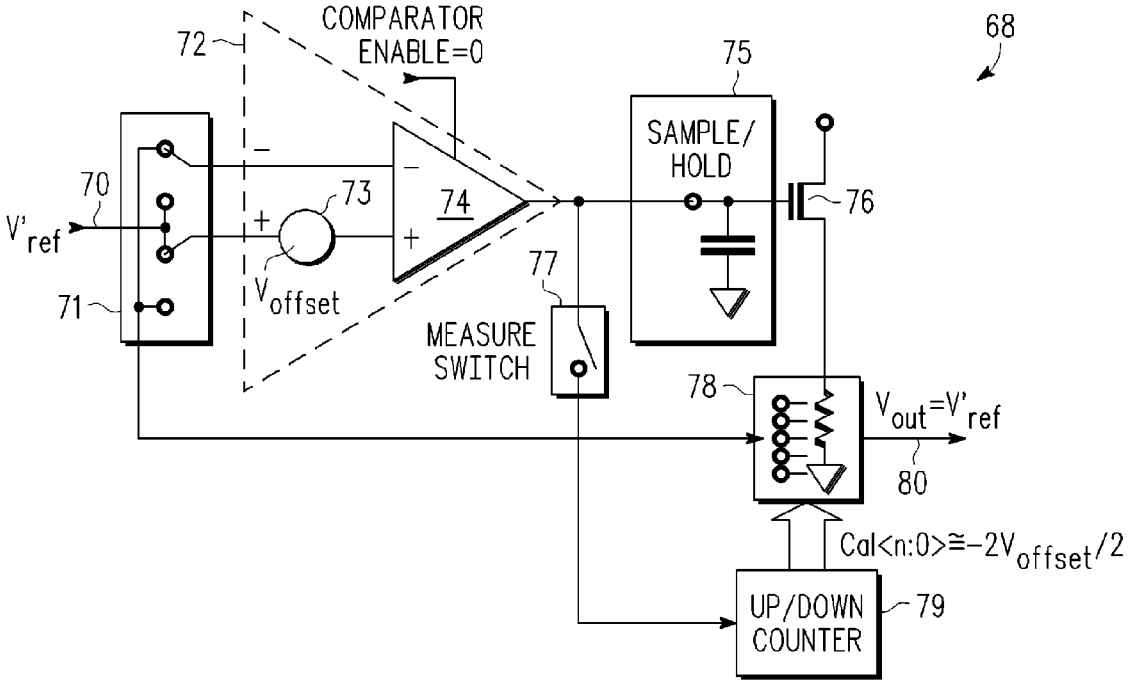
FIG. 8 is a schematic diagram of a built-in self calibrating reference voltage generator circuit that is configured to remove an offset voltage by cancelling the measured offset voltage in accordance with selected embodiments of the present invention.

After measuring the offset voltage, the reference voltage generator circuit 68 returns to an operational mode as shown in FIG. 8. In particular, the input switch 71 connects the offset voltage 73 at the positive input of the amplifier 72 to the desired reference voltage 70 (Vref (prime)), and simultaneously connects the input of the amplifier 72 to the divider circuit 78. In addition, the configurable amplifier 72 is configured as an operational amplifier (Comparator Enable=0), the measure switch 77 is opened to prevent further changes at the counter 79, and the sample and hold circuit 75 is placed in sample mode. With this configuration, the counter 79 is no longer being driven by the output of the opamp/comparator 72, but the digital calibration signal Cal<n:0> output from the counter 79 still represents the previously measured value 2Voffset. If the counter output were simply inverted and applied to the resistor tap 78 to feed back a negative of the offset voltage, the output voltage Vout at the circuit output 80 would contain an error that is equal to twice the offset (Vout=Vref (prime)+2×Voffset) because, during the initial sampling phase, the offset voltage Voffset was sampled as well as the input reference voltage Vref (prime). However, the offset voltage can be cancelled from the circuit output 80 by processing the contents of the counter 79 so that it is inverted (e.g., performing a one's complement on the digital calibration signal Cal<n:0>) and divided by two (e.g., by performing an arithmetic shift of the counter bits toward the LSB) before being applied in feedback. For example, if a seven-bit counter contains the value 0x31 (49) after the measurement phase, after inverting all of the bits, the counter contents will be 0x4e (−50), and after shifting, the counter value will be 0x67 (−25). By applying the processed counter output value to the resistor tap 78, the offset voltage is cancelled from the output 80 of the voltage generator circuit 68.

Figure 9:
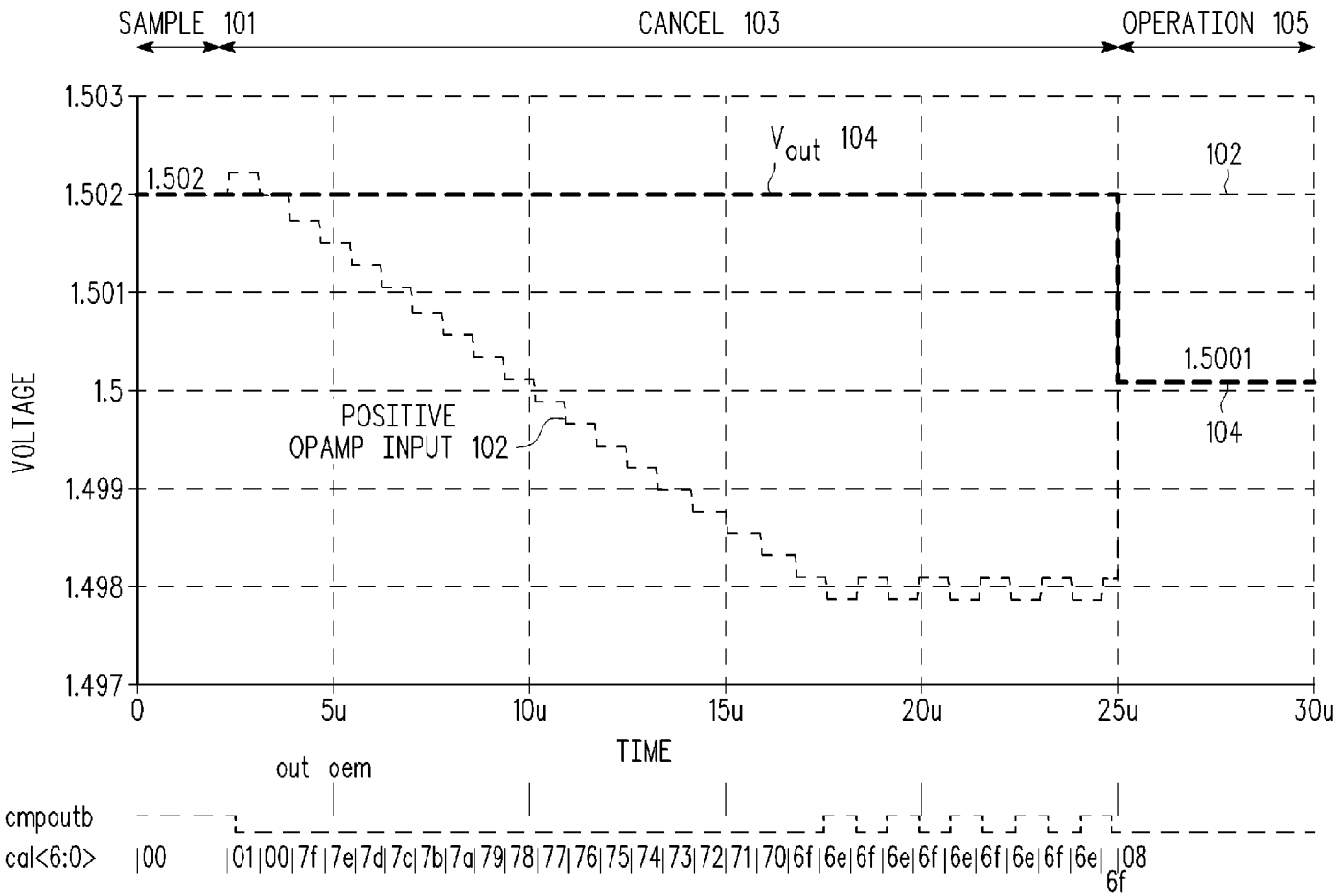
FIG. 9 depicts a simulation plot for the built-in self calibrating reference voltage generator circuit that is configured to remove an offset voltage by sampling, measuring and cancelling the offset voltage in accordance with selected embodiments of the present invention.

As seen from the foregoing, the reference voltage generator circuit cancels the offset voltage in three steps—sampling, cancelling and operating. Each of these steps is depicted in FIG. 9's simulation plot for the built-in self calibrating reference voltage generator circuit 66-68. Plot line 102 simulates the voltage at the positive input to the ideal op amp 74, and plot line 104 simulates the circuit output Vout generated by the reference voltage generator circuit 66-68. For this simulation, the desired voltage Vref (prime) is 1.5V, the amplifier 72 has an offset voltage of 2 mV, and a 7-bit counter is used. During the sample phase 101, the circuit output 104 is 1.502V, which is the sum of the desired voltage Vref (prime) and the offset voltage Voffset. During the cancel phase 103, the circuit output 104 is held at 1.502V by virtue of the sample and hold circuit being placed in a hold mode. However, during the cancel phase 103, the counter moves up or down, depending on whether the output voltage is below or above the desired voltage. Thus, the counter decrements until the voltage fed back from the divider circuit 78 is equal to Vref (prime)−Voffset. In the simulated plot, the counter actually changes during cancellation by an amount equal to two times the offset—from 1.502V to 1.498V. The decrementing sequence of counter values Cal<6:0> for the 7-bit counter is shown at the bottom of FIG. 9, starting at the initial "00" value. The decrementing counter output, in turn, steps down the voltage 102 at the positive input to the op amp 74. Once the output reaches the desired voltage (at approximately 17 us), the counter dithers between the "6e" and "6f" values.

Again, the duration of the cancel phase 103 is determined by the size of the counter so as to allow a sufficient number of clocks that the entire counter range can be clocked if necessary.

After a sufficient number of clocks, the circuit enters an operation phase 105 where the counter is stopped and the inputs for the op amp 72 are swapped. In particular, the positive input to the op amp 72 is connected to the desired voltage reference signal Vref (prime), which causes the positive input to the op amp 74 to increase, as shown by the increase in the plot line 102 at the operation phase 105. In addition, the negative input to the op amp 72 is connected to resistor divider 78. Finally, the divided and inverted counter contents are applied to the resistor taps, the op amp 72 is configured as an amplifier (e.g., by re-connecting the compensation network) and the sample and hold circuit is placed into a sample mode. As a result, the circuit output Vout 104 shifts to within 100 uV of the desired reference voltage (Vref (prime)), as seen by the drop in the plot line 104 in the operation phase 105. By storing the results of dividing and inverting the sampled counter value as offset cancellation data in non-volatile memory, the regulator circuit can be offset voltage can be cancelled for the life of the device.

In accordance with selected embodiments of the present invention, a voltage regulator circuit is also provided which generates the desired output reference voltage by combining the calibration and offset cancellation techniques described herein. An example implementation of such a voltage generator is depicted in FIGS. 10-13 which show a flexibly configured reference voltage generator circuit which uses a four-step algorithm to (1) sample the offset, (2) cancel the offset, (3) sample the reference voltage with offset cancelled and (4) measure the error voltage. To illustrate how to cancel offset voltage errors and calibrate the output voltage, reference is now made to FIG. 10 which depicts in schematic diagram form a built-in self calibrating reference voltage generator circuit 140 (which includes input switches 110, 112 for selectively applying input voltages), a configurable amplifier 114 (which includes a voltage offset component 116 and ideal amplifier 118), a sample and hold circuit 120, and a voltage follower 122 (including a multi-tap resistor divider 126) in the feedback path of the amplifier 114 that is controlled by the programmable up/down counter 128.

Figure 10:
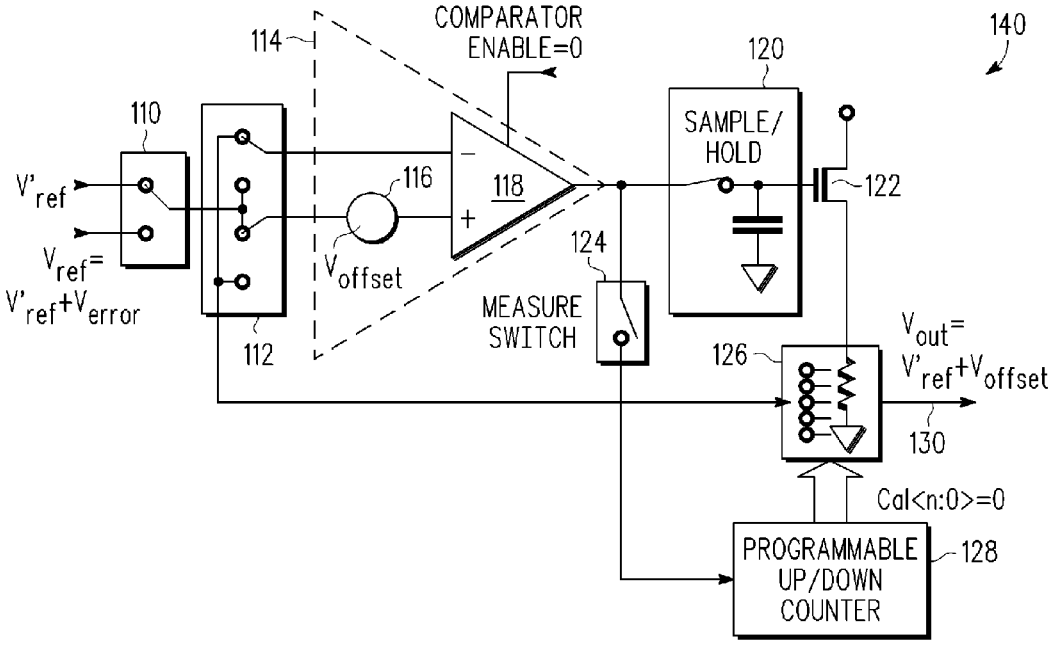
FIG. 10 is a schematic diagram of a built-in self calibrating reference voltage generator circuit that may be configured for calibration and offset cancellation by performing an initial sample operation in accordance with selected embodiments of the present invention.
Figure 11:
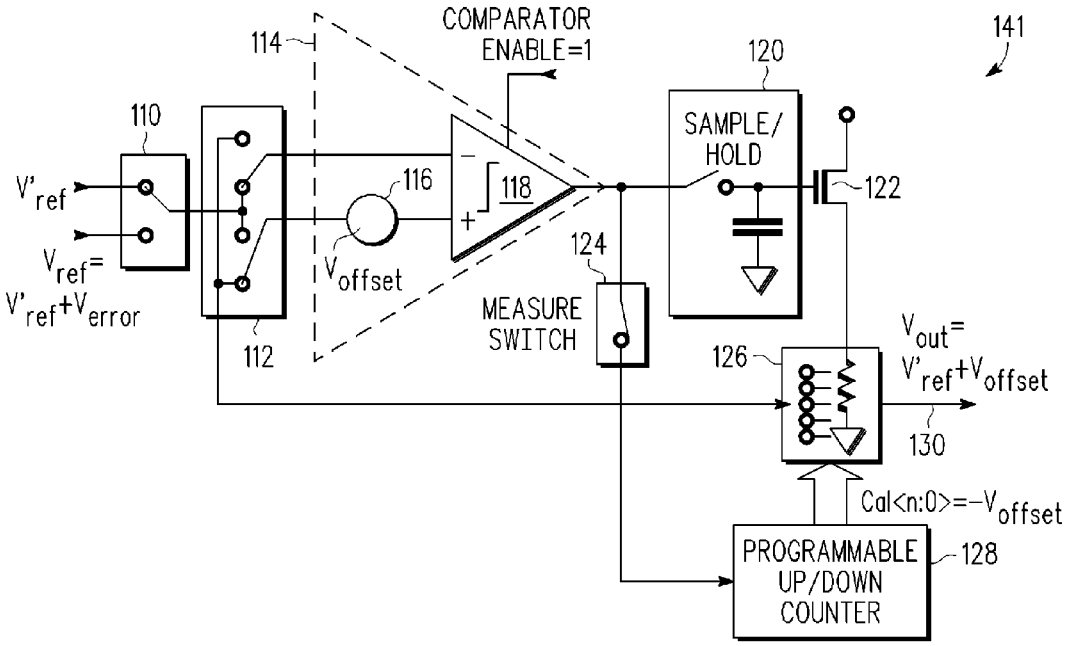
FIG. 11 is a schematic diagram of a built-in self calibrating reference voltage generator circuit that may be configured for calibration and offset cancellation by performing a cancel operation in accordance with selected embodiments of the present invention.
Figure 12:
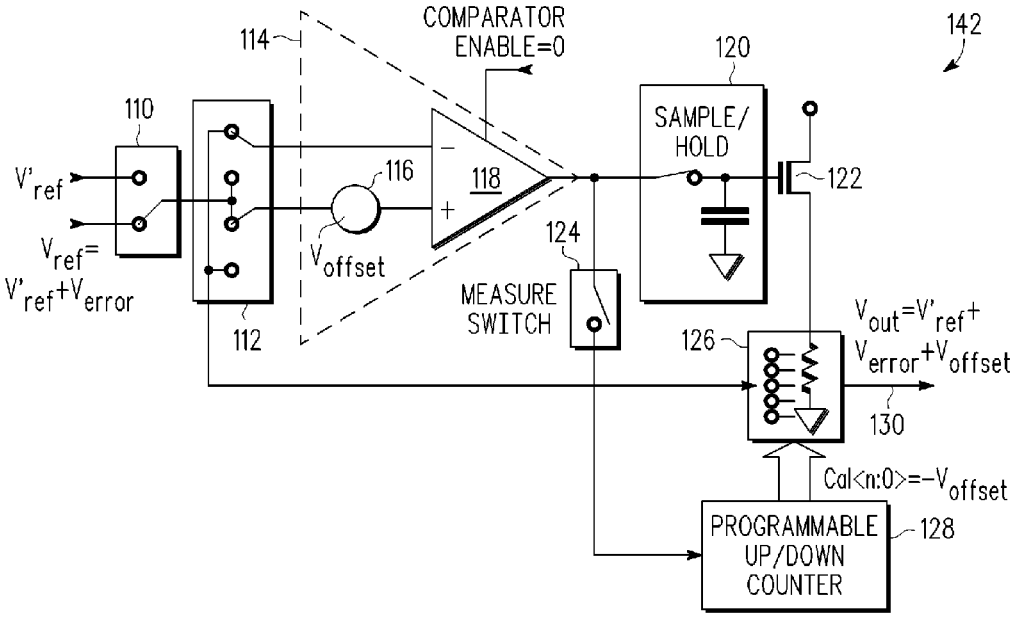
FIG. 12 is a schematic diagram of a built-in self calibrating reference voltage generator circuit that may be configured for calibration and offset cancellation by performing a second sample operation in accordance with selected embodiments of the present invention.
Figure 13:
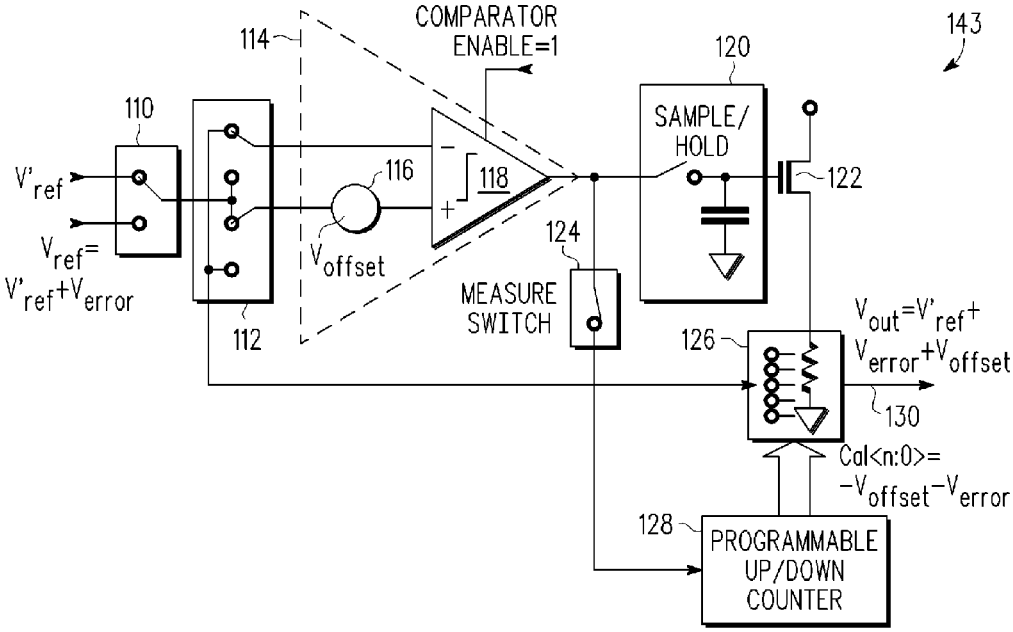
FIG. 13 is a schematic diagram of a built-in self calibrating reference voltage generator circuit that may be configured for calibration and offset cancellation by performing a measure operation in accordance with selected embodiments of the present invention.

As a preliminary step shown in FIG. 10, the reference voltage generator circuit 140 samples the offset voltage 116 by connecting the desired reference voltage Vref (prime) through the input switches 110, 112 to the positive input of the amplifier 114. The next step is illustrated in FIG. 11, which shows that the offset is cancelled at the reference voltage generator circuit 141 by swapping the inputs of the amplifier 114 using the input switches 110, 112, and then converting the measured offset voltage into digital form in the counter 128 (which stores a value equal to twice the offset voltage). Next, the contents of the counter 128 (which represent the offset voltage Voffset) are divided by 2 (arithmetic shift) to cancel the offset (as shown by Cal<n:0>=−Voffset) when the inputs are returned to the normal position. The inputs in the reference voltage generator circuit 142 are then swapped back, as shown in FIG. 12 when the input switches 110, 112 are configured to connect and sample the external reference voltage (Vref (prime)+Verror) at the amplifier 114. At this point, the amplifier 114 behaves as an ideal amplifier in the sense that the offset voltage has effectively been cancelled by inverting and dividing the counter contents. As a result of the sampling, the output voltage is the sum of the desired reference voltage and the error voltage since the offset voltage has been cancelled. In the next step shown in FIG. 13, the reference voltage generator circuit 143 measures the error voltage Verror by converting the measured error voltage into digital form in the counter 128 as described above in the self-calibration discussion, except that the counter 128 starts from the offset count. Finally, the contents of the counter 128 (representing Verror) are inverted and the circuit is returned to normal operation.

Figure 14:
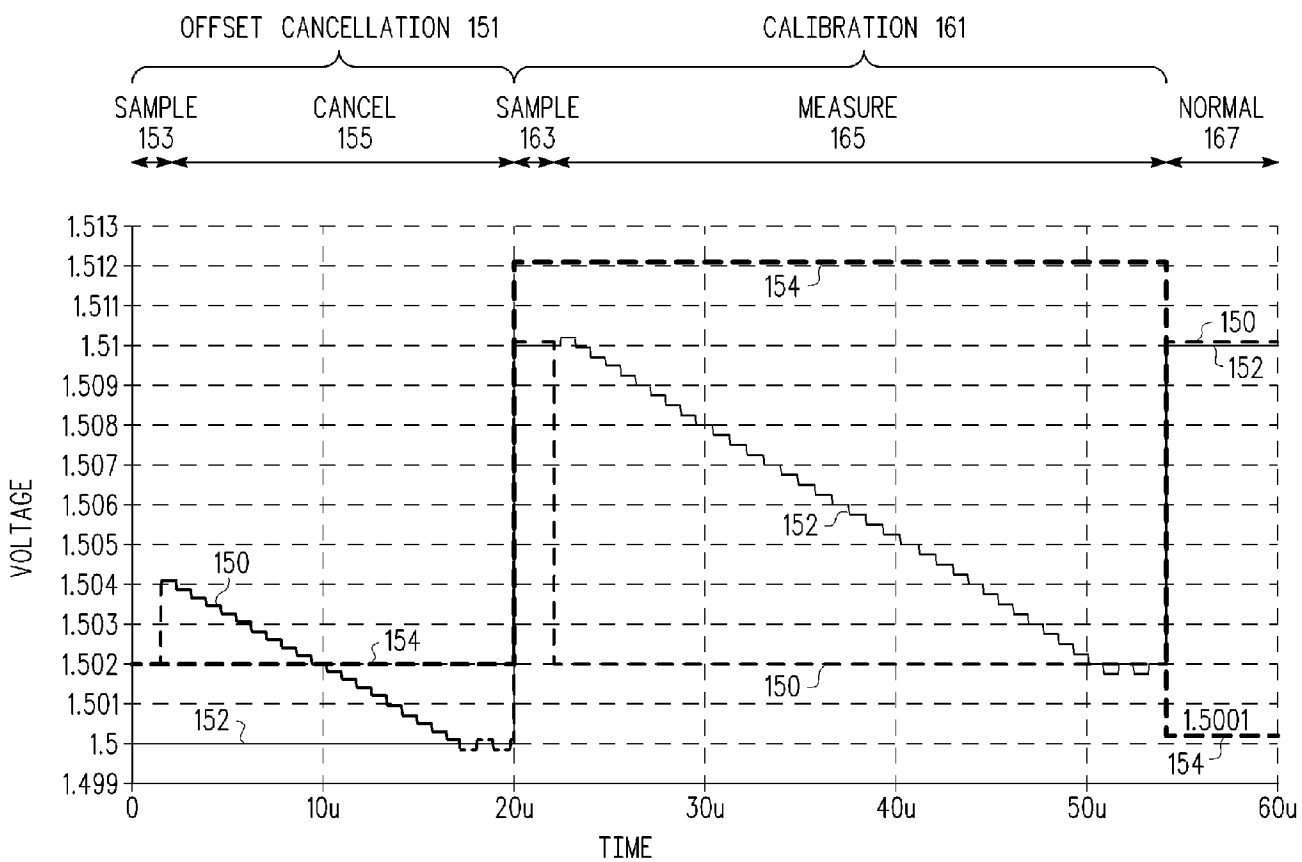
FIG. 14 depicts a simulation plot for the built-in self calibrating reference voltage generator circuit that is configured to remove an offset voltage by sampling, measuring and cancelling the offset voltage in accordance with selected embodiments of the present invention.

As seen from the foregoing, the reference voltage generator circuit 140-143 cancels the offset voltage and calibrates the output to the desired reference voltage in four steps—sample, cancel, sample and measure. Each of these steps is depicted in FIG. 14's simulation plot. Plot line 150 simulates the voltage at the positive input to the op amp 118, plot line 152 simulates the voltage at the negative input to the op amp 118, and plot line 154 simulates the circuit output Vout generated by the reference voltage generator circuit at output 130. For this simulation, the desired voltage Vref (prime) is 1.5V, the amplifier 114 has an offset voltage of 2 mV, the error voltage is 8 mV, and a 7-bit counter is used. During the sample operation 153 in the offset cancellation phase 151, the circuit output 154 is 1.502V, which is the sum of the desired voltage Vref (prime) and the offset voltage Voffset. During the cancel operation 155 of the offset cancellation phase 151, the circuit output 154 is held at 1.502V by virtue of the sample and hold circuit being placed in a hold mode. However, during the cancel operation 155, the counter 128 increments or decrements depending on whether the output voltage is below or above the desired voltage. Thus, the counter 128 decrements from 1.502V to 1.498V for a total change equal to twice the offset voltage. The decrementing counter output, in turn, steps down the voltage 150 at the positive input to the op amp 118. Once the output reaches the desired voltage (at approximately 17 us), the counter dithers until the end of the cancel operation 155. At this point, the calibration phase 161 begins with the sample operation 163 whereby the external reference voltage Vref is sampled. In the plot simulation, the circuit output 154 is 1.512V, which is the sum of the desired voltage Vref (prime), the error voltage Verror, and the offset voltage Voffset. During the measure operation 165 of the calibration phase 161, the circuit output 154 is held at 1.512V by virtue of the sample and hold circuit being placed in a hold mode. However, during the measurement operation 165, the counter 128 increments or decrements depending on whether the output voltage is below or above the desired voltage. Thus, in the simulated plot, the counter 128 decrements for so long as the output of the ideal amplifier 118 is greater than the desired voltage (1.5V). The decrementing counter output, in turn, steps down the voltage 152 at the negative input to the op amp 118. Once the output of the op amp 118 reaches the desired voltage (at approximately 52 us), the counter dithers until the end of the measure operation 165. Finally, for normal operation 167, the contents of the counter 128 are inverted and applied to the resistor divider circuit 126. As a result, the circuit output Vout 154 shifts to within 1 LSB of the desired reference voltage (Vref (prime)), as seen by the drop in the plot line 154 in the normal operation 167.

Figure 15:
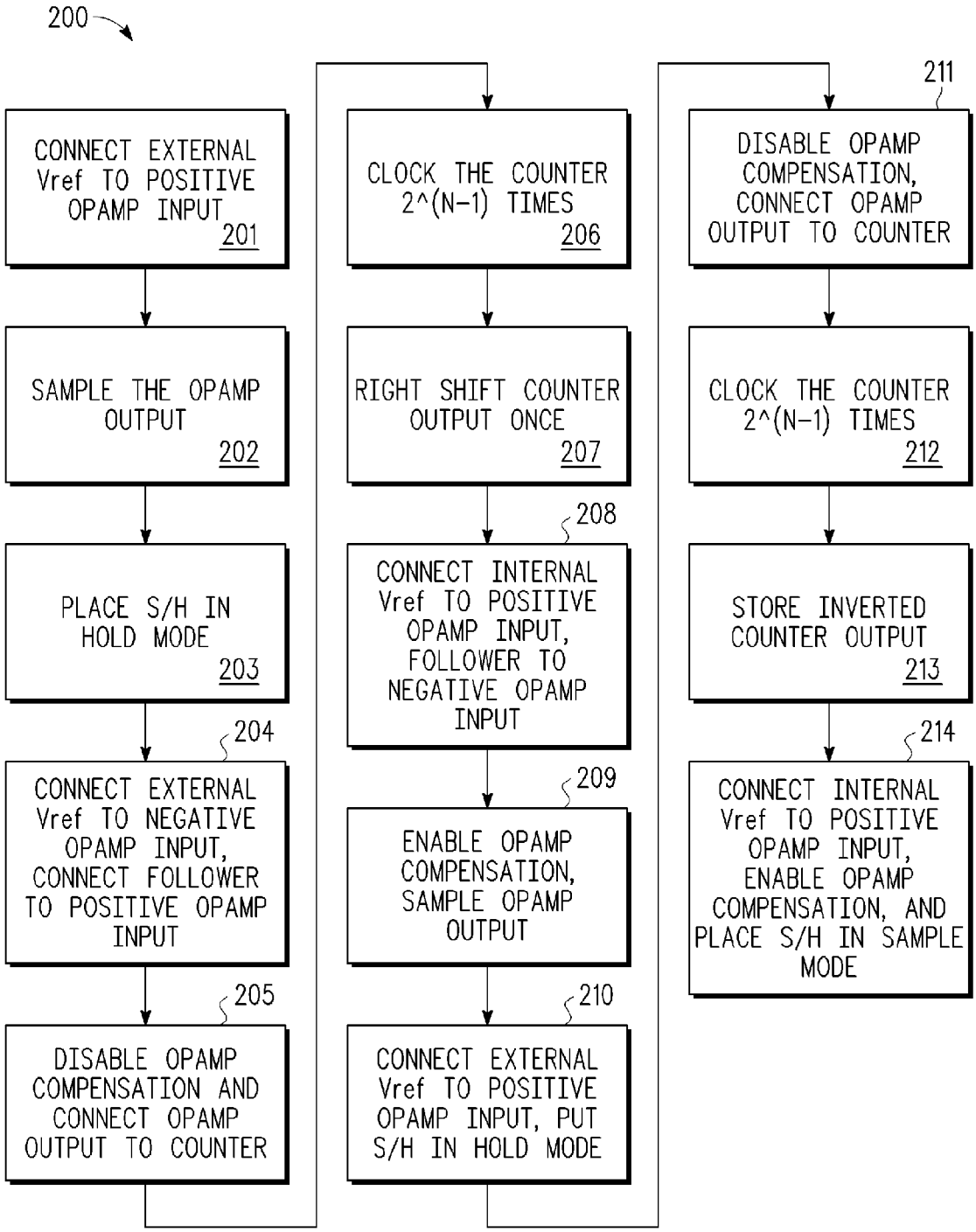
FIG. 15 depicts an example flow diagram for cancelling an offset voltage and calibrating a reference voltage generator circuit in accordance with selected embodiments of the present invention.

To illustrate an example flow diagram 200 for cancelling an offset voltage and calibrating a reference voltage generator circuit, reference is now made to FIG. 15. As an initial step in the offset cancellation portion of the overall operation, an external reference voltage Vref' is connected to the positive input of an opamp (e.g., opamp 114) at step 201. In this configuration, the opamp output is sampled (step 202) by a sample/hold circuit (e.g., S/H circuit 120) until the sample/hold circuit is placed in a hold mode (step 203). The opamp inputs are then swapped at step 204 by connecting the external reference voltage Vref' to the negative input of an opamp (e.g., opamp 114) and by connecting the voltage follower (e.g., 122, 126) to the positive opamp input. Once the opamp inputs are swapped, the frequency compensation for the opamp is disabled to configure the opamp as a comparator, and the opamp output is connected to an up/down counter (e.g., programmable counter 128) at step 205. Thus connected, the counter is clocked $2^{(N-1)}$ times (step 206) to measure the offset voltage Voffset by driving digital calibration signal Cal<n:0> with the counter in response to the comparator output. After the counter is clocked, the digital calibration signal Cal<n:0> will represent a value that is equal to twice the offset voltage error (2×Voffset). To obtain the offset voltage error, the contents of the counter are right shifted one position at step 207, thereby dividing the value in the counter by two. Next, the error correction/calibration portion of the overall operation begins at step 208 by connecting the internal reference voltage Vref to the positive input of an opamp (e.g., opamp 114) and connecting the voltage follower (e.g., 122, 126) to the negative opamp input. Once the opamp inputs are connected, the frequency compensation for the opamp is enabled and the opamp output is sampled at step 209 by the sample/hold circuit (e.g., S/H circuit 120). Once the opamp output is sampled, the sample/hold circuit is placed in a hold mode and the external reference voltage Vref' is connected to the positive opamp input (step 210). Once the external reference voltage Vref' is connected, the frequency compensation for the opamp is disabled to configure the opamp as a comparator, and the opamp output is connected to an up/down counter (e.g., programmable counter 128) at step 211. Thus connected, the counter is clocked $2^{(N-1)}$ times (step 212) to measure the error voltage Verror by driving digital calibration signal Cal<n:0> with the counter in response to the comparator output. After the counter is clocked, the digital calibration signal Cal<n:0> will represent a value that is equal to the negative of the error voltage (−Verror). To obtain the correct error voltage, the contents of the counter are inverted and stored at step 213. At this point, the reference voltage generator circuit enters an operational stage at step 214 by connecting the internal reference voltage Vref to the positive input of the opamp (e.g., opamp 114), enabling the frequency compensation for the opamp, and placing the sample/hold circuit (e.g., S/H circuit 120) in a sample mode.

As will be appreciated, the configuration of the reference voltage generator circuit to perform self-calibration and/or offset cancellation requires a precision voltage Vref (prime) from the tester. An external clock signal for the counter may also be required unless the clock is generated on-chip. In addition, to enable the sampling, canceling, measuring, and normal operation phases, control signals must be applied to the input, sample, and measure switches and the configurable op amp, while a clock signal must be applied to the counter during the cancel and measure phases. The control signals may be generated using dedicated hardware or control logic, a shared processing device, individual processing devices, and/or a plurality of processing devices, where a processing device may be a microprocessor, micro-controller, digital signal processor, microcomputer, central processing unit, field programmable gate array, programmable logic device, state machine, logic circuitry, analog circuitry, digital circuitry and/or any device that manipulates signals (analog and/or digital) based on operational instructions. Once the reference voltage generator circuit has been calibrated, a calibration flag bit in memory may be set to indicate that the part has been calibrated. For example, the calibration flag bit can gate a reset signal so that, during initial power application, the device will calibrate by loading the correction data (namely, the inverted counter value described above) into the resistor divider. Once the calibration is complete and the correction data has been stored, the calibration flag prevents the device from attempting to calibrate during normal use.

By now it should be appreciated that there has been provided a method and system for regulating the voltage generated by a reference voltage circuit. As disclosed, a reference voltage regulation circuit includes an input switch for receiving one or more input voltage signals. In addition, a configurable amplifier is provided that is coupled to the input switch, where the configurable amplifier may be configured to operate as an operational amplifier or as a comparator. A sample and hold circuit is also provided that is coupled to an output of the configurable amplifier, and a voltage follower circuit is provided that is coupled in feedback between the sample and hold circuit and the configurable amplifier for generating an adjusted output voltage at a circuit output, where the voltage follow circuit includes a resistor divider circuit that is controlled by a calibration signal. Finally, a counter circuit is provided that is selectively coupled to the output of the configurable amplifier when configured as a comparator for generating the calibration signal in response to a clock signal, where the calibration signal represents a voltage error component that is removed from the circuit output when the calibration signal is applied to the resistor divider circuit during normal operational. To implement a self calibration algorithm, the input switch may be implemented with a first input switch for coupling either an external reference voltage or a test reference voltage to a positive input terminal of the configurable amplifier. In this case, the configurable amplifier operates as an operational amplifier whenever the external reference voltage is coupled to the positive input terminal of the configurable amplifier, and in addition, the voltage follower circuit is connected through the sample and hold circuit to the configurable amplifier to generate an output voltage at the circuit output during a sampling phase. However, in a subsequent measuring phase, the configurable amplifier is configured to operate as a comparator whenever the test reference voltage is coupled to the positive input terminal of the configurable amplifier, and the counter circuit is controlled by the output of the comparator to generate the calibration signal in response to a clock signal. In the measuring phase, the counter circuit generates a calibration signal substantially representing a negative of the voltage error component that is present in the external reference voltage by counting a digital value during a measuring phase that is substantially equal to the voltage error component, and by then inverting the digital value to generate the calibration signal that is applied to the resistor divider circuit during normal operation. To implement an offset cancellation algorithm, the input switch may be implemented with a dual mode input switch (e.g., a DPDT switch) for providing first and second switch configurations, where the first switch configuration connects a test reference input voltage to a positive input terminal of the configurable amplifier and connects the resistor divider circuit to a negative input terminal of the configurable amplifier, while second switch configuration connects the test reference input voltage to the negative input terminal of the configurable amplifier and connects the resistor divider circuit to the positive input terminal of the configurable amplifier. In this case, a sampling operation is performed by configuring the configurable amplifier as an operational amplifier whenever the test reference input voltage and an op amp offset voltage are coupled to the positive input terminal of the configurable amplifier, and by connecting the voltage follower circuit through the sample and hold circuit to the configurable amplifier to generate an output voltage at the circuit output. However, in a subsequent cancel phase, the configurable amplifier is configured to operate as a comparator whenever the test reference input voltage is coupled to the negative input terminal of the configurable amplifier and, in addition, the counter circuit is controlled by the output of the comparator to generate the calibration signal in response to a clock signal. In the cancel phase, the counter circuit generates a calibration signal substantially representing a negative of the voltage error component that is present as an opamp offset component in the configurable amplifier by counting a digital value during a cancel phase that is substantially equal to twice the opamp offset component and then inverting and dividing the digital value by two to generate the calibration signal that is applied to the resistor divider circuit during normal operation.

In another form, there is provided a method and voltage regulator circuit for generating a calibrated reference voltage. Initially, a reference voltage generated by an operational amplifier is sampled and held, where the operational amplifier includes an opamp output, a positive opamp input for receiving an internal reference voltage and a negative opamp input for receiving in feedback the reference voltage generated by the opamp output. In selected embodiments, the sample and hold process is implemented by first connecting an internal reference voltage to the positive opamp input and connecting a voltage follower circuit between the opamp output and the negative opamp input, and then sampling the opamp output with a sample and hold circuit which is configured to sample an opamp output value, and then finally capturing the opamp output with a sample and hold circuit which is configured to hold the opamp output value. Subsequently, an analog-to-digital converter circuit measures an error voltage component included in the reference voltage by comparing the reference voltage with a desired reference voltage to generate a first digital calibration signal representing a value substantially equal to the error voltage component. In selected embodiments, the measuring process is implemented by connecting the desired reference voltage to the positive opamp input, disabling frequency response compensation in the operational amplifier, setting a counter circuit to a known state, connecting the opamp output to the counter circuit, and then generating the first digital calibration signal from the counter circuit in response to a clock signal. Thereafter, the first digital calibration signal is inverted (e.g., by performing a one's complement on the first digital calibration signal) to generate a second digital calibration signal representing a value substantially equal to a negative of the error voltage component. Lastly, the second digital calibration signal is applied to a resistor tap circuit connected in feedback between the opamp output and the negative opamp input, thereby subtracting a value substantially equal to the voltage error component from the opamp output. To apply the second digital calibration signal to the resistor tap circuit, the internal reference voltage is connected to the positive opamp input, the frequency response compensation in the operational amplifier is enabled, the second digital calibration signal is applied to the resistor tap circuit connected in feedback between the opamp output and the negative opamp input to subtract the value substantially equal to the voltage error component from the opamp output, and the opamp output is sampled with a sample and hold circuit which is configured to sample an opamp output value which is substantially the desired reference voltage. Once the voltage regulator circuit is calibrated, the second digital calibration signal may be stored in memory for subsequent use.

In yet another form, there is provided a method and voltage regulator circuit for generating a reference voltage. As an initial step, a reference voltage generated by an operational amplifier is sampled and held, where the operational amplifier includes an opamp output, a positive opamp input for receiving a desired reference voltage and a negative opamp input for receiving in feedback the reference voltage generated by the opamp output. In selected embodiments, the sample and hold process is implemented by first connecting the desired reference voltage to the positive opamp input and connecting a voltage follower circuit between the opamp output and the negative opamp input, and then sampling the opamp output with a sample and hold circuit which is configured to sample an opamp output value, and then finally capturing the opamp output with a sample and hold circuit which is configured to hold the opamp output value. Subsequently, an analog-to-digital converter circuit measures an offset voltage component included in the reference voltage by comparing the reference voltage with a desired reference voltage to generate a first digital calibration signal representing a value substantially equal to twice the offset voltage component. In selected embodiments, the measuring process is implemented by connecting the desired reference voltage to the negative opamp input, connecting the voltage follower circuit between the opamp output and the positive opamp input, disabling the frequency response compensation in the operational amplifier, setting a counter circuit to a known state, connecting the opamp output to the counter circuit, and generating the first digital calibration signal from the counter circuit in response to a clock signal. Thereafter, the first digital calibration signal is inverted (e.g., by performing a one's complement on the first digital calibration signal to generate an intermediate value) and divided by two (e.g., by right-shifting the intermediate value) to generate a second digital calibration signal representing a value substantially equal to a negative of the offset voltage component. Lastly, the second digital calibration signal is applied to a resistor tap circuit connected in feedback between the opamp output and the negative opamp input, thereby subtracting a value substantially equal to the offset voltage component from the opamp output. To apply the second digital calibration signal to the resistor tap circuit, the desired reference voltage is connected to the positive opamp input and the voltage follower circuit is connected between the opamp output and the negative opamp input, the frequency response compensation in the operational amplifier is enabled, the second digital calibration signal is applied to the resistor tap circuit connected in feedback between the opamp output and the negative opamp input to subtract the value substantially equal to the offset voltage component from the opamp output, and the opamp output is sampled with a sample and hold circuit which is configured to sample an opamp output value which is substantially the desired reference voltage.

Although the described exemplary embodiments disclosed herein are directed to methods and systems for regulating a reference voltage by calibrating the voltage to remove voltage errors in the source voltage and/or cancelling offset voltages, the present invention is not necessarily limited to the example embodiments illustrate herein, and various embodiments of a voltage regulator circuit and methodology disclosed herein may be implemented with other circuit components. For example, a successive approximation register can be used to replace the programmable up/down counter. Thus, the particular embodiments disclosed above are illustrative only and should not be taken as limitations upon the present invention, as the invention may be modified and practiced in different but equivalent manners apparent to those skilled in the art having the benefit of the teachings herein. Accordingly, the foregoing description is not intended to limit the invention to the particular form set forth, but on the contrary, is intended to cover such alternatives, modifications and equivalents as may be included within the spirit and scope of the invention as defined by the appended claims so that those skilled in the art should understand that they can make various changes, substitutions and alterations without departing from the spirit and scope of the invention in its broadest form.

Benefits, other advantages, and solutions to problems have been described above with regard to specific embodiments. However, the benefits, advantages, solutions to problems, and any element(s) that may cause any benefit, advantage, or solution to occur or become more pronounced are not to be construed as a critical, required, or essential feature or element of any or all the claims. As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A reference voltage regulation circuit, comprising:

an input switch for receiving one or more input voltage signals;

a configurable amplifier coupled to the input switch, where the configurable amplifier may be configured to operate as an operational amplifier or as a comparator;

a sample and hold circuit coupled to an output of the configurable amplifier;

a voltage follower circuit coupled in feedback between the sample and hold circuit and the configurable amplifier for generating an adjusted output voltage at a circuit output, where the voltage follow circuit comprises a resistor divider circuit that is controlled by a calibration signal; and a counter circuit selectively coupled to the output of the configurable amplifier when configured as a comparator for generating the calibration signal in response to a clock signal, where the calibration signal represents a voltage error component that is removed from the circuit output when the calibration signal is applied to the resistor divider circuit during normal operational.

2. The reference voltage regulation circuit of claim 1, where the input switch comprises a first input switch for coupling either an external reference voltage or a test reference voltage to a positive input terminal of the configurable amplifier.

3. The reference voltage regulation circuit of claim 2, where the configurable amplifier is configured to operate as an operational amplifier whenever the external reference voltage is coupled to the positive input terminal of the configurable amplifier and where the voltage follower circuit is connected through the sample and hold circuit to the configurable amplifier to generate an output voltage at the circuit output during a sampling phase.

4. The reference voltage regulation circuit of claim 2, where the configurable amplifier is configured to operate as a comparator whenever the test reference voltage is coupled to the positive input terminal of the configurable amplifier and where the counter circuit is controlled by the output of the comparator to generate the calibration signal in response to a clock signal during a measuring phase.

5. The reference voltage regulation circuit of claim 2, where the counter circuit generates during a measuring phase a calibration signal substantially representing a negative of the voltage error component that is present in the external reference voltage by counting a digital value during a measuring phase that is substantially equal to the voltage error component and then inverting the digital value to generate the calibration signal that is applied to the resistor divider circuit during normal operation.

6. The reference voltage regulation circuit of claim 1, where the input switch comprises a dual mode input switch for providing first and second switch configurations, where the first switch configuration connects a test reference input voltage to a positive input terminal of the configurable amplifier and connects the resistor divider circuit to a negative input terminal of the configurable amplifier, while second switch configuration connects the test reference input voltage to the negative input terminal of the configurable amplifier and connects the resistor divider circuit to the positive input terminal of the configurable amplifier.

7. The reference voltage regulation circuit of claim 6, where the configurable amplifier is configured to operate as an operational amplifier whenever the test reference input voltage and an op amp offset voltage are coupled to the positive input terminal of the configurable amplifier and where the voltage follower circuit is connected through the sample and hold circuit to the configurable amplifier to generate an output voltage at the circuit output during a sampling phase.

8. The reference voltage regulation circuit of claim 6, where the configurable amplifier is configured to operate as a comparator whenever the test reference input voltage is coupled to the negative input terminal of the configurable amplifier and where the counter circuit is controlled by the output of the comparator to generate the calibration signal in response to a clock signal during a cancel phase.

9. The reference voltage regulation circuit of claim 6, where the counter circuit generates during a cancel phase a calibration signal substantially representing a negative of the voltage error component that is present as an opamp offset component in the configurable amplifier by counting a digital value during the cancel phase that is substantially equal to twice the opamp offset component and then inverting and dividing the digital value by two to generate the calibration signal that is applied to the resistor divider circuit during normal operation.

10. A method for generating a calibrated reference voltage, comprising:

sampling and holding a reference voltage generated by an operational amplifier comprising an opamp output, a positive opamp input for receiving an internal reference voltage and a negative opamp input for receiving in feedback the reference voltage generated by the opamp output;

measuring an error voltage component included in the reference voltage with an analog-to-digital converter circuit which compares the reference voltage with a desired reference voltage to generate a first digital calibration signal representing a value substantially equal to the error voltage component;

inverting the first digital calibration signal to generate a second digital calibration signal representing a value substantially equal to a negative of the error voltage component;

applying the second digital calibration signal to a resistor tap circuit connected in feedback between the opamp output and the negative opamp input to subtract the value substantially equal to the voltage error component from the opamp output.

11. The method claim 10, where sampling and holding the reference voltage comprises:

connecting an internal reference voltage to the positive opamp input and connecting a voltage follower circuit between the opamp output and the negative opamp input;

sampling the opamp output with a sample and hold circuit which is configured to sample an opamp output value; and capturing the opamp output with a sample and hold circuit which is configured to hold the opamp output value.

12. The method claim 10, where measuring the error voltage component comprises:

connecting the desired reference voltage to the positive opamp input;

disabling frequency response compensation in the operational amplifier;

setting a counter circuit to a known state;

connecting the opamp output to the counter circuit; and generating the first digital calibration signal from the counter circuit in response to a clock signal.

13. The method claim 10, where inverting the first digital calibration signal comprises performing a one's complement on the first digital calibration signal to generate the second digital calibration signal.

14. The method claim 10, where applying the second digital calibration signal to the resistor tap circuit comprises:

connecting the internal reference voltage to the positive opamp input;

enabling frequency response compensation in the operational amplifier;

applying the second digital calibration signal to the resistor tap circuit connected in feedback between the opamp output and the negative opamp input to subtract the value substantially equal to the voltage error component from the opamp output; and sampling the opamp output with a sample and hold circuit which is configured to sample an opamp output value which is substantially the desired reference voltage.

15. The method claim 10, further comprising storing the second digital calibration signal in memory.

16. A method for generating a reference voltage, comprising:

sampling and holding a reference voltage generated by an operational amplifier comprising an opamp output, a positive opamp input for receiving a desired reference voltage and a negative opamp input for receiving in feedback the reference voltage generated by the opamp output;

measuring an offset voltage component included in the reference voltage with an analog-to-digital converter circuit which compares the reference voltage with a desired reference voltage to generate a first digital calibration signal representing a value substantially equal to twice the offset voltage component;

inverting and dividing by two the first digital calibration signal to generate a second digital calibration signal representing a value substantially equal to a negative of the offset voltage component;

applying the second digital calibration signal to a resistor tap circuit connected in feedback between the opamp output and the negative opamp input to subtract the value substantially equal to the offset voltage component from the opamp output.

17. The method claim 16, where sampling and holding the reference voltage comprises:

connecting the desired reference voltage to the positive opamp input and connecting a voltage follower circuit between the opamp output and the negative opamp input;

sampling the opamp output with a sample and hold circuit which is configured to sample an opamp output value; and capturing the opamp output with a sample and hold circuit which is configured to hold the opamp output value.

18. The method claim 16, where measuring the offset voltage component comprises:

connecting the desired reference voltage to the negative opamp input and connecting the voltage follower circuit between the opamp output and the positive opamp input;

disabling frequency response compensation in the operational amplifier;

setting a counter circuit to a known state;

connecting the opamp output to the counter circuit; and generating the first digital calibration signal from the counter circuit in response to a clock signal.

19. The method claim 16, where inverting and dividing by two the first digital calibration signal comprises performing a one's complement on the first digital calibration signal to generate an intermediate value, and right-shifting the intermediate value to generate the second digital calibration signal.

20. The method claim 16, where applying the second digital calibration signal to the resistor tap circuit comprises:

connecting the desired reference voltage to the positive opamp input and connecting the voltage follower circuit between the opamp output and the negative opamp input;

enabling frequency response compensation in the operational amplifier;

applying the second digital calibration signal to the resistor tap circuit connected in feedback between the opamp output and the negative opamp input to subtract the value substantially equal to the offset voltage component from the opamp output; and sampling the opamp output with a sample and hold circuit which is configured to sample an opamp output value which is substantially the desired reference voltage.

* * * * *